US005803752A

United States Patent [19]

McHugh

[11] Patent Number: 5,803,752

[45] Date of Patent: Sep. 8, 1998

[54] BOARD-TO-BOARD CONNECTOR

[75] Inventor: Robert G. McHugh, Evergreen, Colo.

[73] Assignee: Hon Hai Precision Industry Co., Ltd., Taipei, Taiwan

[21] Appl. No.: 566,958

[22] Filed: Dec. 4, 1995

[51] Int. Cl.[6] ..... H01R 9/09

[52] U.S. Cl. ..... 439/74; 439/495; 439/660

[58] Field of Search ..... 439/274, 660, 439/492, 493, 494, 495

[56] References Cited

U.S. PATENT DOCUMENTS

| | | | |
|---|---|---|---|
| 4,349,238 | 9/1982 | Sherman et al. | 439/70 |
| 4,662,701 | 5/1987 | Lane | 439/676 |
| 4,734,060 | 3/1988 | Kawawada et al. | 439/660 |
| 4,969,840 | 11/1990 | Ii et al. | 439/445 |
| 5,192,232 | 3/1993 | Lenz et al. | 439/660 |
| 5,199,884 | 4/1993 | Kaufman et al. | 439/74 |
| 5,277,597 | 1/1994 | Masami et al. | 439/660 |
| 5,376,009 | 12/1994 | Olsson et al. | 439/74 |
| 5,409,406 | 4/1995 | McClure | 439/857 |
| 5,599,192 | 2/1997 | Olson | 439/660 |
| 5,626,482 | 5/1997 | Chan et al. | 439/74 |

*Primary Examiner*—P. Austin Bradley
*Assistant Examiner*—T. C. Patel
*Attorney, Agent, or Firm*—Birch, Stewart, Kolasch & Birch,LLP

[57] ABSTRACT

There are two alternatives to a board-to-board connector. One alternative includes a first connector and a second connector. The assembly of the first connector and the second connector is capable of electrically connecting a hard circuit board to another hard circuit board. The other alternative includes the first connector and a cap. The assembly of the cap and the first connector is capable of electrically connecting a flexible circuit board to a hard circuit board.

12 Claims, 9 Drawing Sheets

BOARD-TO-BOARD CONNECTOR

BACKGROUND OF THE INVENTION

1. Field of the Invention

The present invention relates to a board-to-board connector. In particular, the present invention relates to a board-to-board connector adapted for connecting a flexible circuit board to a hard circuit board or connecting a hard circuit board to another hard circuit board.

2. Description of Prior Art

A mother circuit board that carries various electrical elements is generally utilized in an electrical device to supply its main functions. A plurality of connectors are soldered on the mother circuit board for receiving daughter circuit boards to expand the function of the electrical device. The daughter circuit boards may be hard circuit boards or flexible circuit boards. However, the two kinds of daughter circuit boards require different connectors. This necessitates more molds, production lines and stocks. Additional storage and production costs for the connectors are also unavoidable.

SUMMARY OF THE INVENTION

An object of the present invention is to provide a board-to-board connector which is adapted for connecting a flexible circuit board to a hard circuit board or connecting a hard circuit board to another hard circuit board, whereby the storage and production costs for the connectors can be reduced. In accordance with the object of the present invention, there is provided a board-to-board connector which comprises:

a first connector body having a first side wall; a second side wall; a third side wall opposite to the first side wall; a fourth side wall opposite to the second side wall; and a base connected to the first, second, third and fourth side walls, wherein a plurality of receiving spaces are provided in the first connector body;

a plurality of first contact terminals firmly mounted in the receiving spaces, each of which has a first terminal body; a first terminal arm extending out from the first terminal body; and a first contact portion curved and formed at the free end of the first terminal arm and exposed to a space surrounded by the side walls;

a second connector body having a main body inserted into the space surrounded by the side walls; and two wings extending from the main body to make the cross section of the second connector body substantially T-shaped, wherein a plurality of passages are provided on each of the wings; and a plurality of second contact terminals firmly mounted in the passages, each of which has a second terminal body correspondingly touching the first contact portion of one of the first contact terminals.

Alternatively, there is provided a board-to-board connector which comprises:

a first connector body with a plurality of receiving spaces provided therein, the first connector body having a first side wall; a second side wall; a third side wall opposite to said first side wall; a fourth side wall opposite to said second side wall; a base connected to said first, second, third and fourth side walls; and at least one first and second protrusions connected to one of the side walls, wherein the top surface of the second protrusion is lower than the bottom surface of the first protrusion, with respect to the base;

a plurality of first contact terminals firmly mounted in the receiving spaces, each of which has a first terminal body; a first terminal arm extending out from the first terminal body; and a first contact portion curved and formed at the free end of the first terminal arm and exposed to a space surrounded by the side walls; and a cap having a cover plate provided with a slot; two side plates respectively perpendicularly connected to the cover plate, at least one of which is provided with a window for correspondingly receiving the first and second protrusions; and a central engagement wall arranged between the side plates and perpendicularly connected to the cover plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be more fully understood by reading the subsequent detailed description and examples with references made to accompanying drawings, wherein.

DETAILED DESCRIPTION OF THE PREFERRED EMBODIMENT

Figure 1:
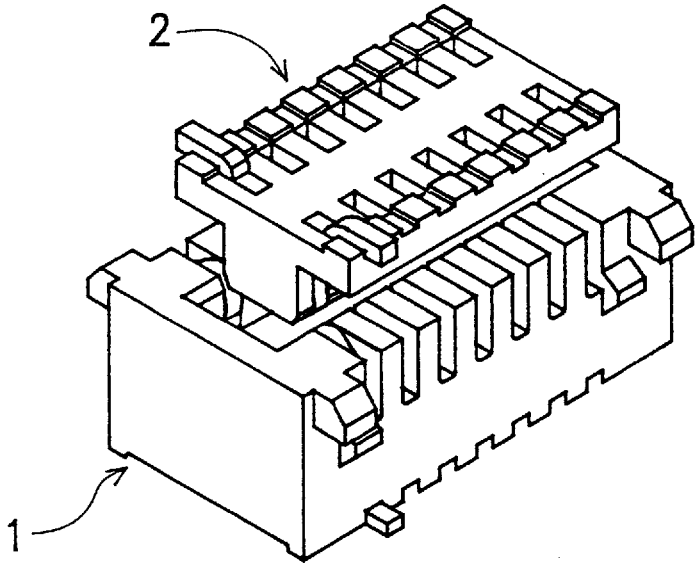
FIG. 1 is a perspective diagram of a first connector and a second connector according to the preferred embodiment of the board-to-board connector of this invention.
Figure 2:
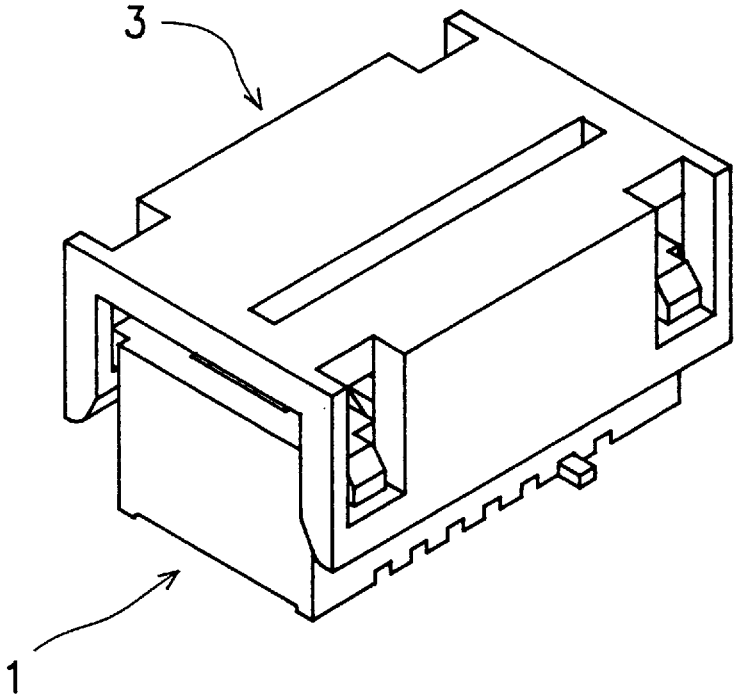
FIG. 2 is a perspective diagram of a cap and a first connector according to the preferred embodiment of the board-to-board connector of this invention.

There are two alternatives to the board-to-board connector in accordance with a preferred embodiment of this invention. One is the assembly of a first connector 1 and a second connector 2, as shown in FIG. 1, which is adapted for electrically connecting a hard circuit board to another hard circuit board. The other is the assembly of a cap 3 and the first connector 1, as shown in FIG. 2, which is adapted for electrically connecting a flexible circuit board to a hard circuit board.

Figure 3:
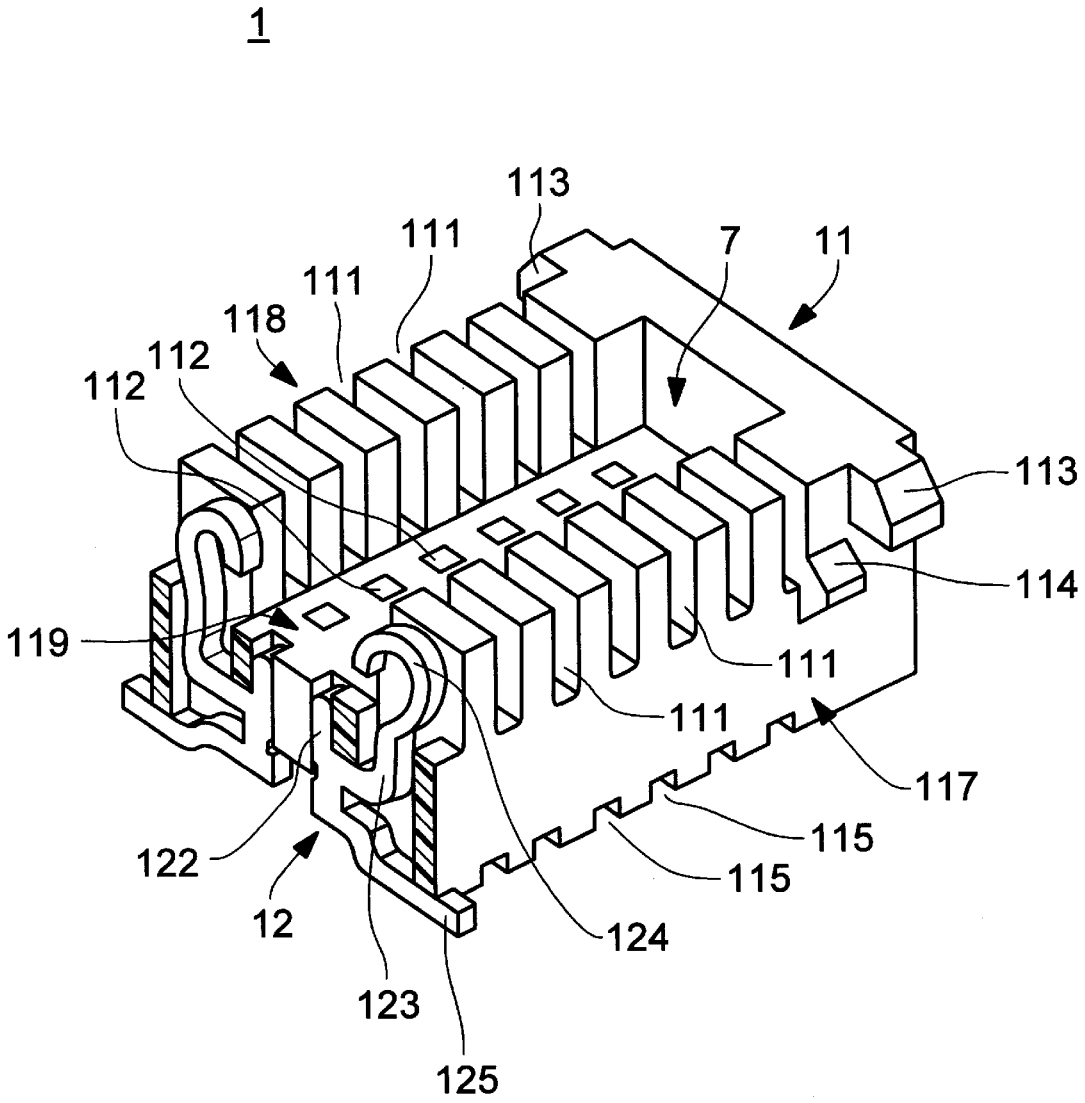
FIG. 3 is a partial perspective diagram of the first connector according to FIG. 1.

The first connector comprises a plastic (or insulative) connector body and a plurality of contact terminals. Please refer to FIG. 3, in which a part of the plastic connector body 11 has been cut and removed while only a pair of contact terminals 12 are mounted in the plastic connector body 11. This arrangement is for easily describing the first connector 1.

The plastic connector body 11 comprises a base 119 and four side walls commonly defining an interior cavity 7 therein, however, only two opposite side walls are indicated by reference numbers 117 and 118. A plurality of first grooves 111 and second grooves 115 are respectively formed on the upper portion and the lower portion of each of the side walls 117, 118. Two rows of through holes 112 corresponding to the first grooves 111 and the second grooves 115 are provided on the base 119. Also, each corresponding first groove 111, through hole 112 and second groove 115 communicate with each other in the plastic connector body 11 to form a receiving space for receiving one of the contact terminals 12.

Figure 4:
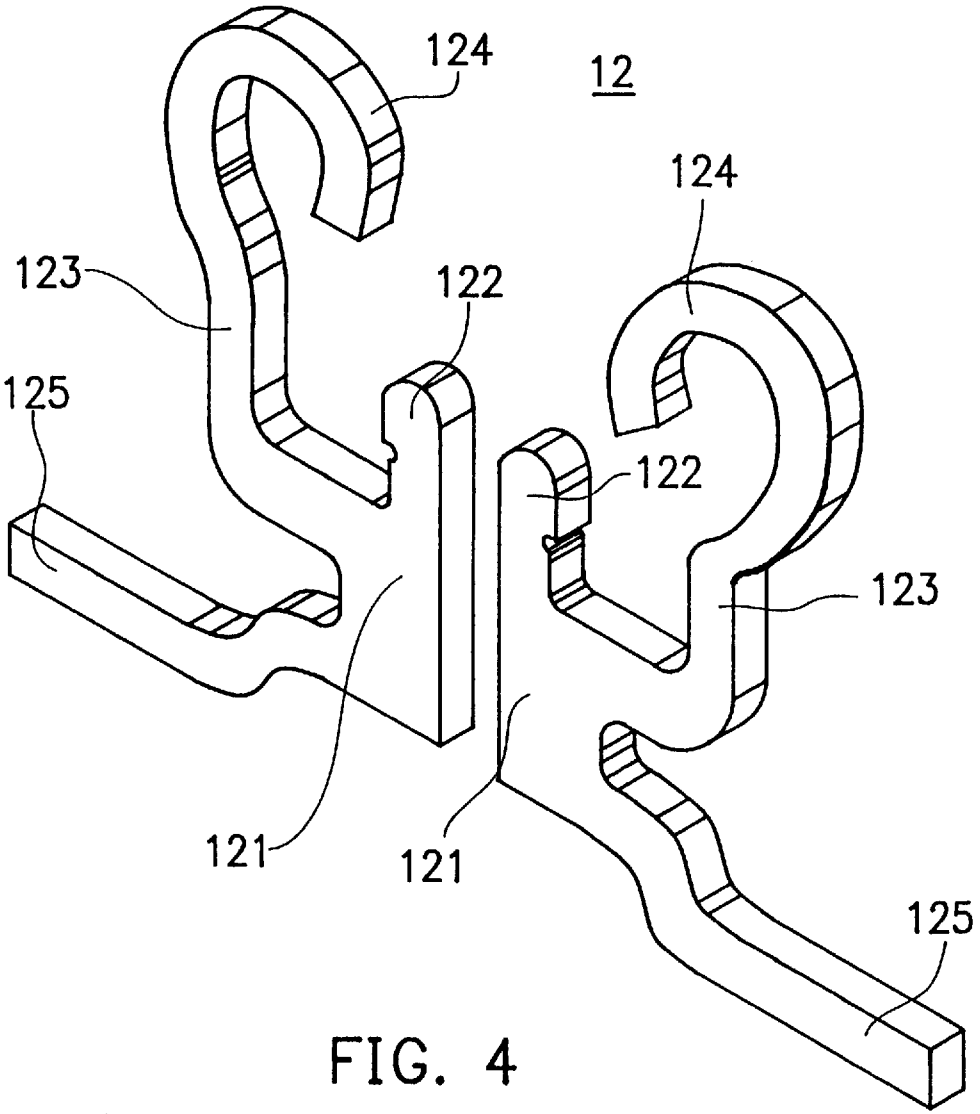
FIG. 4 is a perspective diagram of the contact terminals according to FIG. 3.

As shown in FIG. 4, each contact terminal 12 has a terminal body 121, an engaging portion 122, a terminal arm 123, a contact portion 124 and a terminal leg 125, all of which are coplanar. The engaging portion 122 is formed at one end of the terminal body 121, while the terminal arm 123 and the terminal leg 125 respectively extend out from one side of the terminal body 121. Furthermore, the contact portion 124 is curved and formed at the free end of the terminal arm 123.

Please refer back to FIG. 3, wherein the contact terminal 12 is firmly mounted in the plastic connector body 11 by way of the engaging portion 122 fitted into the through hole 112; the terminal leg 125 of the contact terminal 12 is received in the second groove 115 and extends out of the plastic connector body 11; the terminal arm 123 of the contact terminal 12 is received in the first groove 111; and the contact portion 124 is exposed to the space surrounded by the side walls.

A couple of first protrusions 113 and second protrusions 114 are provided on the exterior surface of each of the side walls 117, 118. It is noted that the bottom surfaces of the first protrusions 113 are higher than the top surfaces of the second protrusions 114.

Figure 5:
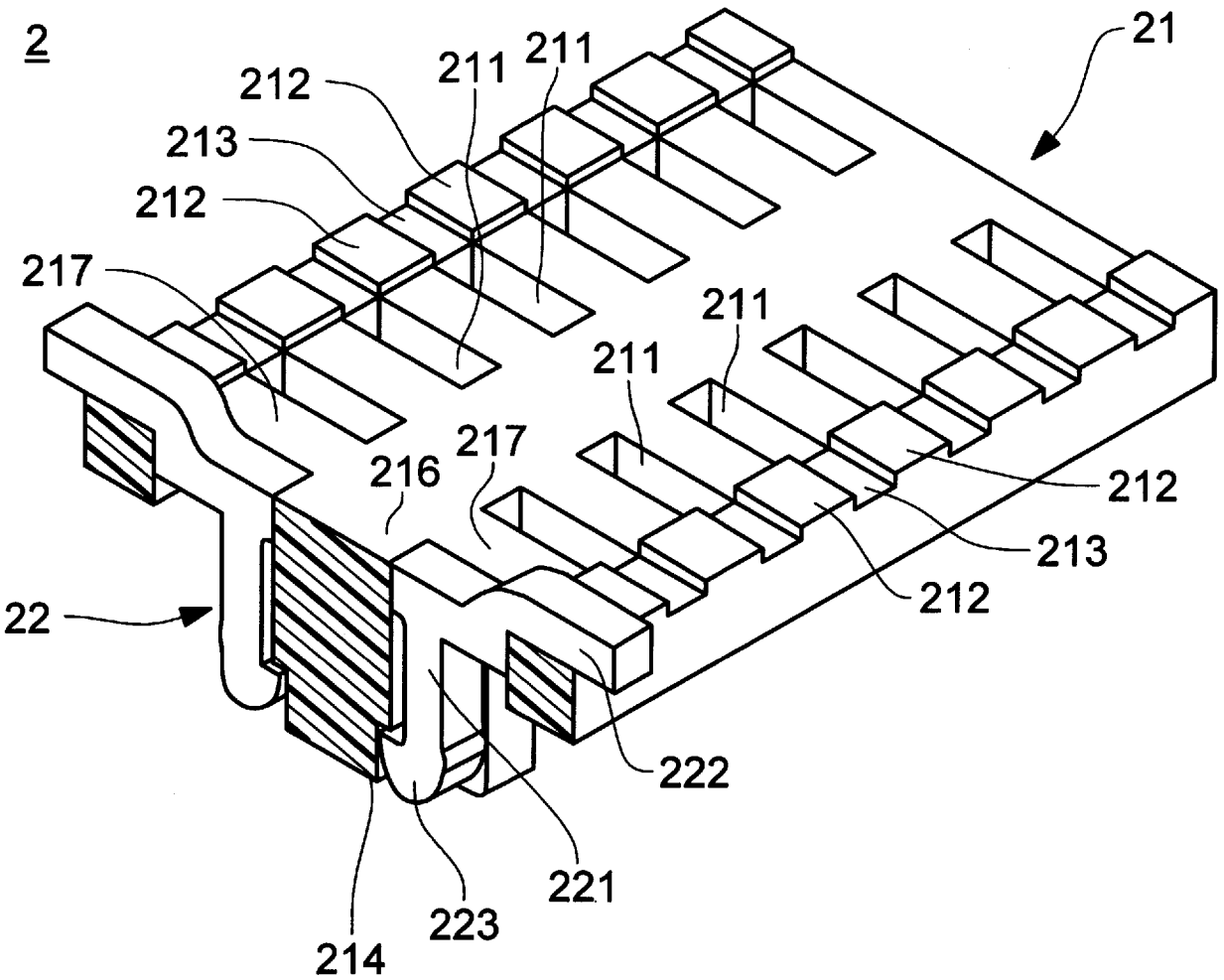
FIG. 5 is a partial perspective diagram of the second connector according to FIG. 1.

The second connector comprises a plastic connector body and a plurality of contact terminals. Please refer to FIG. 5, wherein a part of the plastic connector body 21 has been cut and removed while only a pair of contact terminals 22 are mounted in the plastic connector body 21. This arrangement is also for easily describing the second connector 2.

The cross section of the plastic connector body 21 is substantially T-shaped. The plastic connector body 21 has a main body 216 and two wings 217 which extend from the upper portion of the main body 216. A plurality of spaced platforms 212 are provided on the top surface of each wing 217 so that a plurality of valleys 213 are respectively formed between any two of the platforms 212. A plurality of passages 211 corresponding to the valleys 213 are provided on each of the wings 217 and extend downward along both sides of the main body 216 to form recesses 214 on the bottom of the main body 216.

Figure 6:
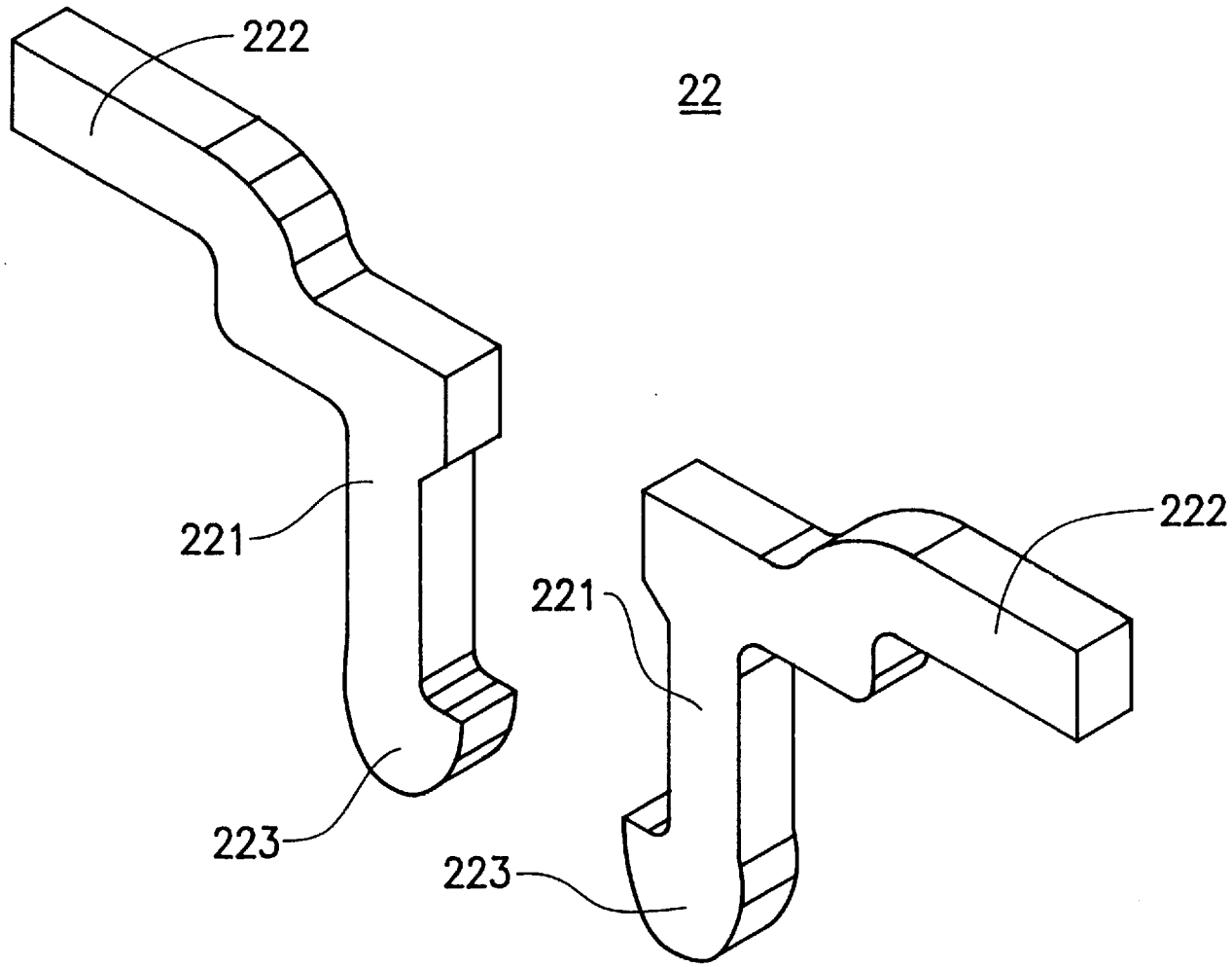
FIG. 6 is a perspective diagram of the contact terminals according to FIG. 5.

As shown in FIG. 6, each contact terminal 22 is substantially L-shaped and has a terminal body 221. One end of the terminal body 221 forms a hook 223 while the other end extends opposite to the hook 223 to form a terminal leg 222. The terminal body 221, the hook 223 and the terminal leg 222 are coplanar.

Figure 7:
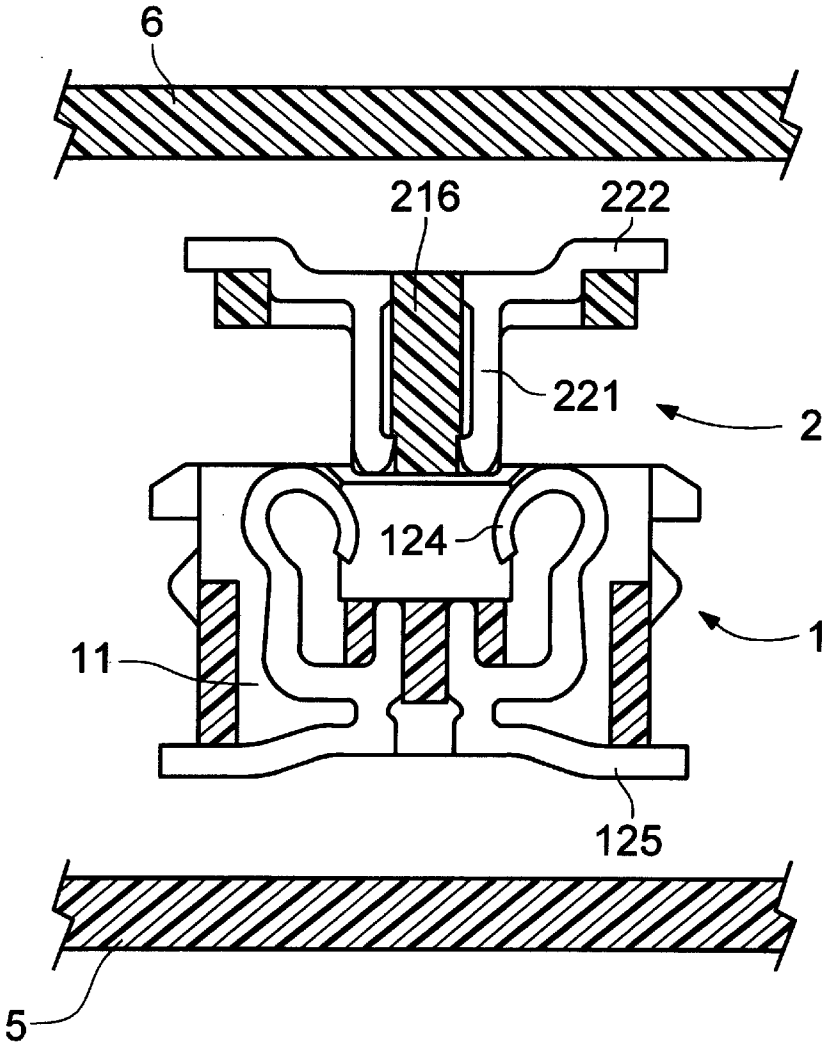
FIG. 7 is a cross-section diagram of a first connector, a second connector and two hard circuit boards according to a preferred embodiment of this invention.

Please refer back to FIG. 5, wherein the contact terminal 22 is inserted into the plastic connector body 21 with its terminal body 221 fitted in the passage 211 and its hook 223 received in the recess 214. Furthermore, the terminal leg 222 of the contact terminal 22 passes through the valley 213 and extends beyond the edge of the wing 217. It is noted that the top surface of the terminal leg 222 is 35 above the platform 212. As shown in FIG. 7, the main body 216 of the second connector 2 is inserted into the central interior cavity 7 of the plastic connector body 11 of the first connector 1 so that the terminal body 221 of the second connector 2 comes into contact with the contact portion 124 of the first connector 1. Furthermore, the terminal legs 125 of the first connector 1 and the terminal legs 222 of the second connector 2 are respectively soldered on the two hard circuit boards 5, 6 whereby the hard circuit board 5 is electrically connected to the hard circuit board 6.

Figure 8:
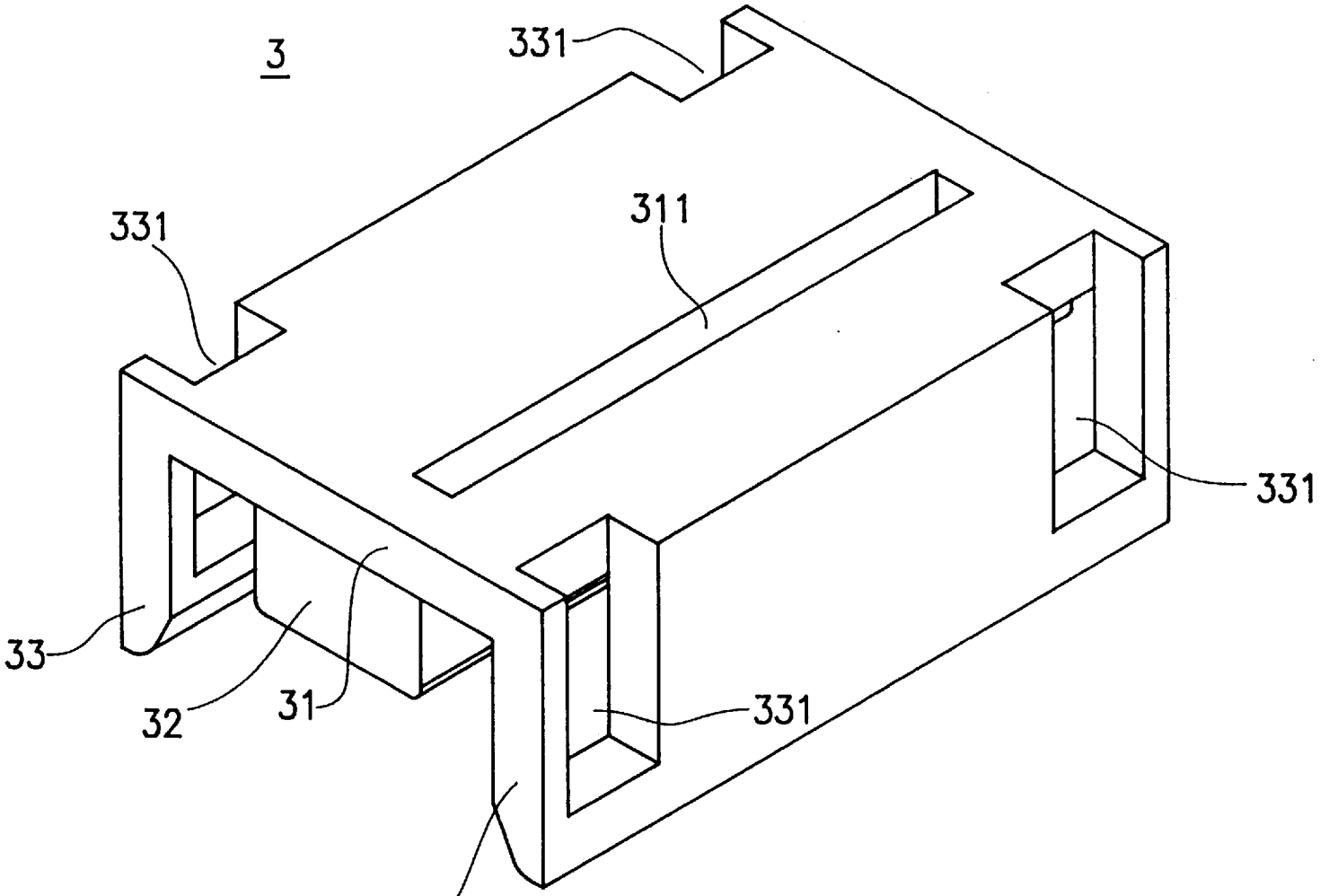
FIG. 8 is a perspective diagram of the cap according to FIG. 2.
Figure 9:
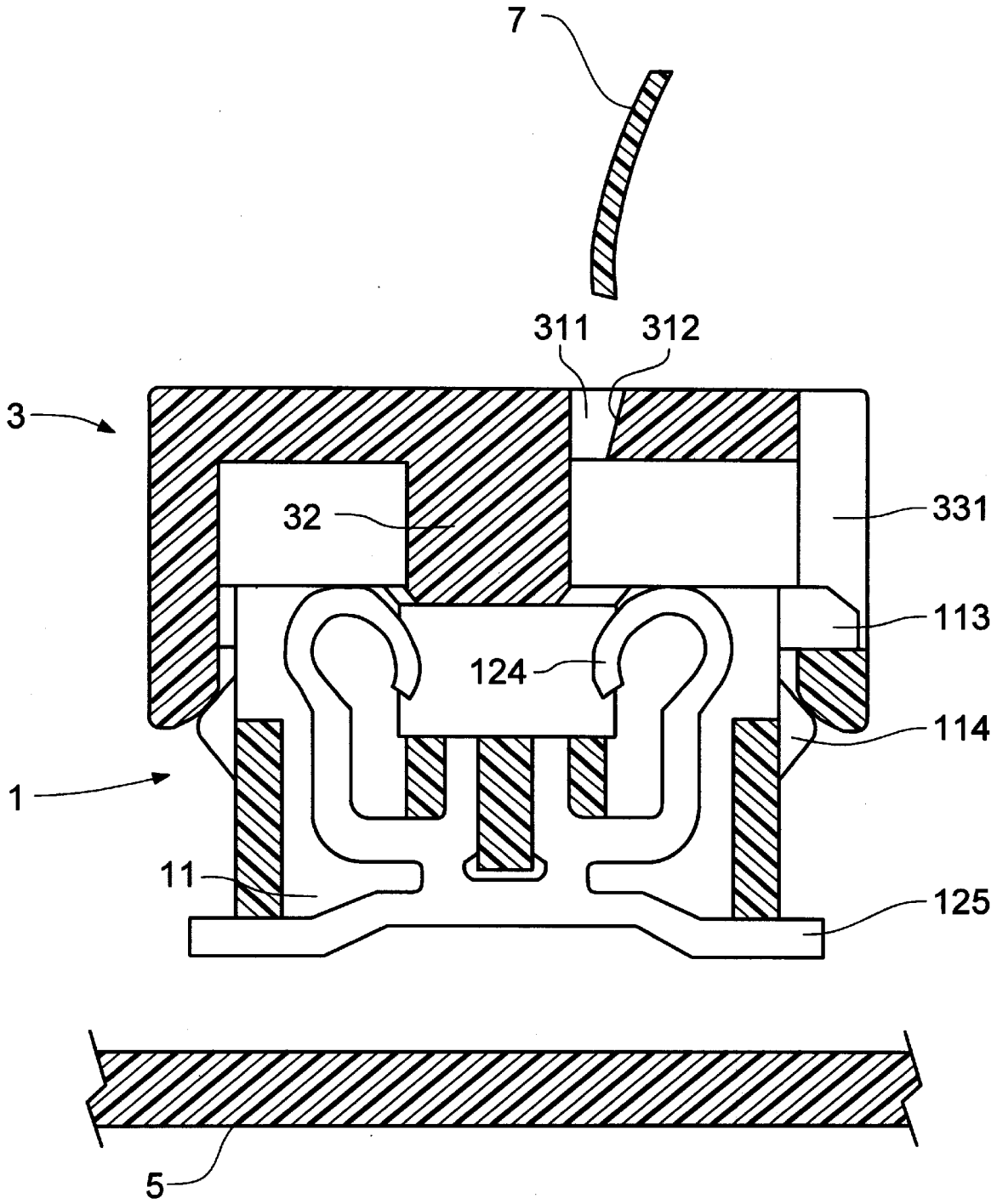
FIG. 9 is a cross-section diagram of a cap, a first connector, a hard circuit board and a flexible circuit board according to a preferred embodiment of this invention, wherein the right side portion of the cap is further cut-away to show the upper protrusion of the first connector engaged within the window of the cap.

As shown in FIG. 8, the cap 3 comprises a cover plate 31, a central engagement wall 32 and two side plates 33 wherein the two side plates 33 and the central engagement wall 32 are perpendicularly connected to the cover plate 31 with the central engagement wall 32 arranged between the two side plates 33. Two pairs of windows 331 corresponding to the above-mentioned first and second protrusions 113, 114 are respectively provided on the two side plates 33. Each window 331 can receive both one first protrusion 113 and one second protrusion 114. Furthermore, a slot 311 is formed on the cover plate 31 near one of the side plates 33. As shown in FIG. 9, the slot 311 has an inclined inner wall 312.

The assembly of the cap 3 and the first connector 1 can be utilized for electrically connecting a flexible circuit board 7 to a hard circuit board 5. The first protrusions 113 of the first connector 1 are pushed into the windows 331 of the cap 3. At this time, the cap 3 is initially arranged in the upper position wherein the lower edge portion of the cap 3 butts the second protrusions 114 of the first connector 1 to temporarily retain the cap 3 in position and not to downward move, while the first protrusions 113 of the first connector 1 is appropriately engaged within the window 331 of the cap 3 for preventing the cap 3 from moving upward. As shown in FIG. 9, the first connector 1 and the cap 3 are ready for an insertion of a flexible circuit board 7.

Figure 10:
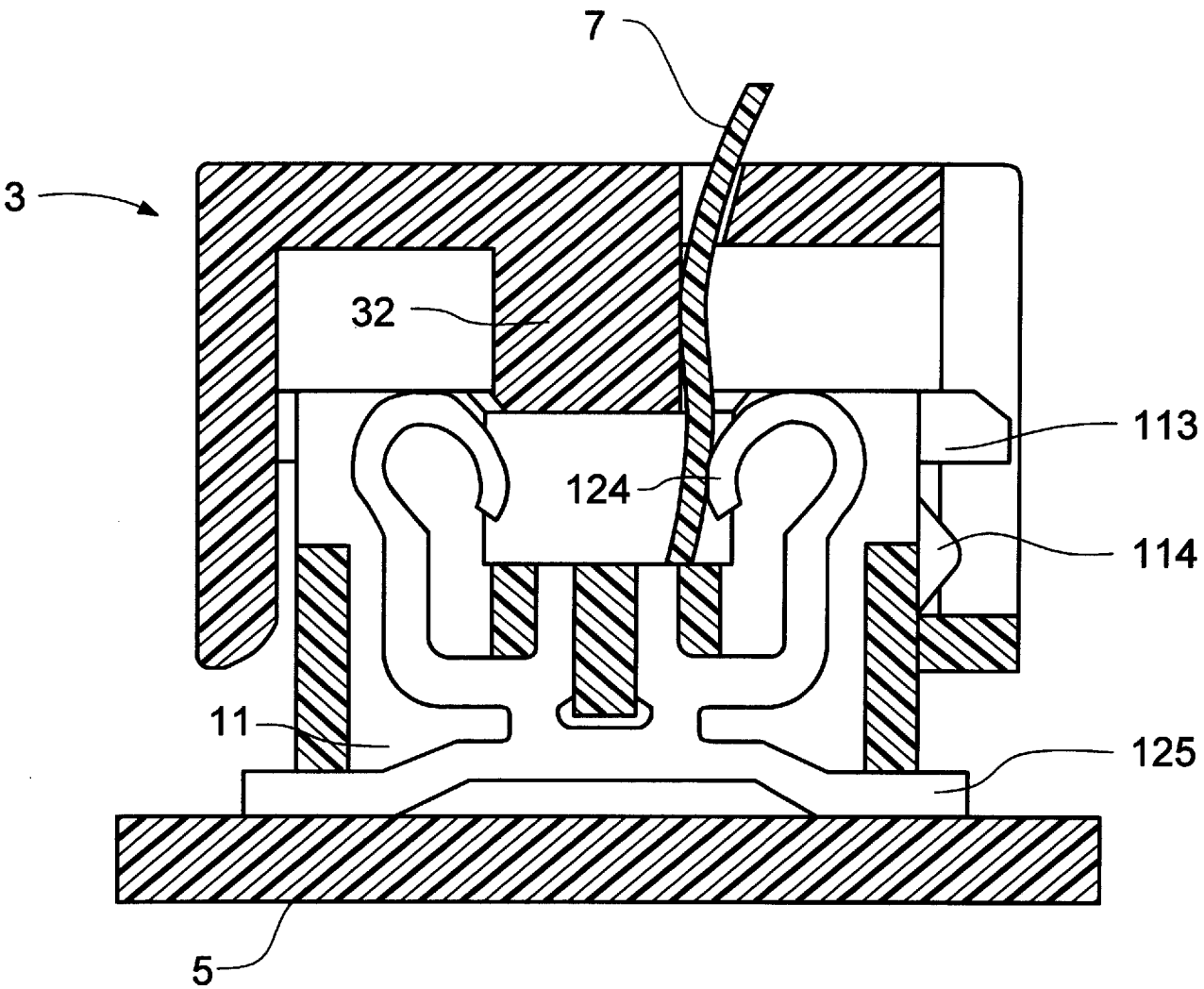
FIG. 10 is a cross section diagram of a cap, a first connector, a hard circuit board and a flexible circuit board according to FIG. 9, wherein the lower protrusion of the first connector is engaged within the window of the cap for firmly assembling the cap onto the first connector.

The flexible circuit board 7 can be inserted into the first connector 1 through the slot 311 of the cap 3 and the inclined inner wall 312 of the slot 311 facilitates the insertion. Then, the cap 3 and the first connector 1 further relatively move toward each other and the second protrusions 114 are pushed into the windows 331 so that the cap 3 is in the lower position with regard to the first connector 1 and is fixed to the first connector 1. As a result, the flexible circuit board 7 is pinched by the central engagement wall 32 of the cap 3 and the contact portion 124 of the contact terminal 12 of the first connector 1, as shown in FIG. 10. Furthermore, the terminal leg 125 of the contact terminal 12 of the first connector 1 is soldered on the first hard circuit board 5 whereby the flexible circuit board 7 and the first hard circuit board 5 are electrically connected.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given.

What is claimed is:

1. A board-to-board connector comprising:

a first connector body having a first side wall, a second side wall, a third side wall opposite to said first side wall, a fourth side wall opposite to said second side wall, a base connected to said first, second, third and fourth side walls, a plurality of through holes penetrate through said base, a plurality of receiving spaces defined by said through holes and first and second grooves located on end portions of said first and third walls, each groove communicates with each through hole, said receiving spaces are provided in said first connector body, a first protrusion formed on an exterior surface of at least one of said first and second sidewalls, a second protrusion formed on the exterior surface having said first protrusion, said second protrusion is spaced apart from said first protrusion according to a predetermined spacial relationship, an interior cavity;

a plurality of first contact terminals firmly mounted in said receiving spaces, each of which has a first terminal body, a first terminal arm extending out from said first terminal body, a first contact portion curved and formed at a free end of said first terminal arm, said first contact portion extending into the interior cavity formed by said side walls, an engaging portion formed at one end at said first terminal body and fitted in one of said through holes, a terminal leg extending out from said first terminal body;

a second connector body having a main body inserted into said interior cavity formed by said side walls, and two wings extending from said main body to make the cross section of said second connector body substantially T-shaped, wherein a plurality of passages are provided in each of said wings; and a plurality of second contact terminals firmly mounted in said passages, each of which has a second terminal body correspondingly touching said first curved contact of one of said first contact terminals, whereby said first connector provides a connection between at least one of a hard circuit board to a flexible circuit board wherein said first connector body connects to a cap, said flexible circuit board being inserted into said cap, and a hard circuit board to a hard circuit board.

2. The board-to-board connector as claimed in 1, wherein said second connector body further has a plurality of spaced platforms connected to each of said wings wherein between two platforms a valley is formed, said second connector having a plurality of valleys, and each of said second contact terminals has a second terminal leg extending out from said second terminal body and passing through one of said valleys between each two of said platforms.

3. The board-to-board connector as claimed in 2, wherein each of said second contact terminals further has a hook extending from said second terminal body opposite to said second terminal leg; and said passages further extend and form a plurality of recesses on both sides of said main body for receiving said hooks of said second contact terminals.

4. A board-to-board connector comprising:

a first connector body with a plurality of receiving spaces provided therein, said first connector body having a first side wall, a second side wall, a third side wall opposite to said first side wall, a fourth side wall opposite to said second side wall, a base connected to said first, second, third and fourth side walls, a plurality of through holes penetrate through said base, a plurality of receiving spaces defined by said through holes and first and second grooves located on end portions of said first and third walls, each groove communicates with each through hole, a first and second protrusion connect to one of said side walls, wherein a top surface of said second protrusion is lower than a bottom surface of said first protrusion, with respect to said base;

a plurality of first contact terminals firmly mounted in said receiving spaces, each of which has a first terminal body a first terminal arm extending out from said first terminal body, and a first contact portion curved and formed at the free end of said first terminal arm and exposed to a space surrounded by said side walls, an engaging portion formed at one end of said first terminal body and fitted in one of said through holes; and a cap having a cover plate provided with a slot, two side plates respectively perpendicularly connected to said cover plate, at least one of which is provided with a window for correspondingly receiving said first and second protrusions, and a central engagement wall arranged between said side plates and perpendicularly connected to said cover plate, whereby said first connector provides a connection between at least one of a hard circuit board to a flexible circuit board and a hard circuit board to a hard circuit board.

5. A board-to-board connector as claimed in claim 4, wherein said slot of said cap has an inclined inner wall.

6. A board-to-board connector as claimed in 4, wherein said first terminal body, said first engaging portion, said first terminal arm, said first contact portion and said first terminal leg are coplanar.

7. A cap comprising:

a cover plate provided with a slot disposed along a longitudinal axis which has an inclined inner wall;

two side plates respectively perpendicularly connected to said cover plate, each plate includes at least two windows which are substantially parallel to said longitudinal axis; and a central engagement wall arranged between said side plates and perpendicularly connected to said cover plate.

8. A board-to-board connector assembly for use with either two hard circuit boards or with one hard circuit board and one flexible circuit board, said assembly comprising:

a first connector including an insulative body comprising at least a first side wall and an opposite spaced second side wall commonly defining an interior cavity therebetween to receive a main body of a second connector under a first situation wherein said board-to-board connector assembly is applied to a first interconnection system of two hard circuit boards, a base connected to said first and said second side walls, a plurality of receiving spaces defined by a plurality of through holes penetrating through said base and first and second grooves located on end portions of said first and second side walls, each groove communicates with each through hole, said receiving spaces are provided in said first connector body; or said first connector further including fastening means for being adapted to securely latch thereon a cap, said fastening means includes a first protrusion formed on an exterior surface of at least one of said first and second sidewalls, a second protrusion formed on the exterior surface having said first protrusion, said second protrusion being spaced apart from said first protrusion according to a predetermined spacial relationship, said cap comprises an engagement wall incorporating the flexible circuit board for being commonly received within said interior cavity of said first connector under a second situation wherein said board-to-board connector assembly is applied to a second interconnection system of one hard circuit board and one flexible circuit board.

9. The assembly as claimed in claim 8, wherein said cap includes a slot for allowing an insertion of the flexible circuit board into the interior cavity in the first connector.

10. A board-to-board connector assembly for use with either two hard circuit boards or with one hard circuit board and one flexible circuit board, said assembly comprising:

a first connector including an insulative body having a first set of terminals therein for engagement with a second set of terminals of a second connector under a first situation wherein said board-to-board connector assembly is applied to a first interconnection system of two hard circuit boards, said insulative body including a base connected to a first and second side walls, a plurality of receiving spaces defined by a plurality of through holes penetrating through said base and first and second grooves located on end portions of said first and second side walls, each groove communicates with each through hole, said receiving spaces are provided in said first connector body; or said first connector further including fastening means for being adapted to securely latch thereon a cap, said fastening means includes a first protrusion formed on an exterior surface of at least one of said first and second sidewalls, a second protrusion formed on the exterior surface having said first protrusion, said second protrusion is spaced apart from said first protrusion according to a predetermined spacial relationship, wherein said cap incorporates the flexible circuit board to have the first set of terminals of the first connector engaged with corresponding circuits on said flexible circuit board under a second situation wherein said board-to-board connector assembly is applied to a second interconnection system of one hard circuit board and one flexible circuit board.

11. A connector for use with either a complementary connector or a cap associated with a flexible circuit board, said connector comprising:

an insulative body having a first set of terminals therein for engagement with a second set of terminals of said complementary connector under a first situation that said connector and the complementary connector are both respectively mounted on two hard circuit boards, said insulative body including a base connected to a first and said second side walls, a plurality of receiving spaces defined by a plurality of through holes penetrating through said base and first and second grooves located on end portions of said first and second walls, each groove communicates with each through hole, said receiving spaces are provided in said first connector body, said connector further including means for assembling the cap and the associated flexible circuit board thereto under a second situation that the first connector is mounted on a hard circuit board wherein the first set of terminals of said connector engage respectively circuits on the flexible circuit board, said means for assembling the cap and associated flexible circuit board includes a first protrusion formed on an exterior surface of at least one of said first and second sidewalls, a second protrusion formed on the exterior surface having said first protrusion, said second protrusion is spaced apart from said first protrusion according to a predetermined spacial relationship.

12. The connector as claimed in claim 11, wherein said means includes a cavity in the connector for reception of an engagement wall of the cap and the associated flexible circuit board therein so that the engagement wall incorporates the associated flexible circuit board to engage the corresponding first set terminals of the connector.

* * * * *